US005694871A

United States Patent [19]

Tippmann, Sr.

[11] Patent Number: 5,694,871

[45] Date of Patent: Dec. 9, 1997

[54] MANUALLY OPERATED STITCHER

[75] Inventor: Dennis J. Tippmann, Sr., New Haven, Ind.

[73] Assignee: Tippmann Pneumatics, Inc., Fort Wayne, Ind.

[21] Appl. No.: 618,251

[22] Filed: Mar. 18, 1996

[51] Int. Cl.[6] ..... D05B 69/04

[52] U.S. Cl. ..... 112/154; 112/169; 112/220; 112/284

[58] Field of Search ..... 112/169, 154, 112/189, 185, 190, 284, 220, 320, 237–239

[56] References Cited

U.S. PATENT DOCUMENTS

| | | | |
|---|---|---|---|
| 306,996 | 10/1884 | Barber | 112/169 |
| 389,081 | 9/1888 | Ingraham et al. . | |
| 402,597 | 5/1889 | Hubbell . | |
| 559,637 | 5/1896 | Tracy | 112/320 |
| 668,481 | 2/1901 | Benoit . | |
| 1,809,192 | 6/1931 | Cahill et al. . | |
| 2,176,977 | 10/1939 | Nicolay . | |
| 2,206,484 | 7/1940 | Monroe . | |
| 2,479,017 | 8/1949 | Merson et al. . | |
| 2,507,814 | 5/1950 | Rantanen . | |
| 2,594,534 | 4/1952 | Bell . | |
| 3,165,080 | 1/1965 | Castelletti . | |
| 3,390,652 | 7/1968 | Morris . | |
| 3,435,789 | 4/1969 | Kuramochi . | |
| 3,745,950 | 7/1973 | Kato . | |
| 3,834,333 | 9/1974 | Seyama . | |
| 3,837,306 | 9/1974 | Doyel . | |
| 3,957,004 | 5/1976 | Ketterer et al. . | |
| 4,185,573 | 1/1980 | Naito . | |
| 4,236,470 | 12/1980 | Stenson . | |
| 4,401,043 | 8/1983 | Peterson . | |
| 4,428,312 | 1/1984 | Ketterer . | |
| 4,501,211 | 2/1985 | Seyama . | |
| 4,503,791 | 3/1985 | Killinger . | |
| 4,505,213 | 3/1985 | Killinger . | |
| 4,535,711 | 8/1985 | Ketterer . | |
| 5,389,103 | 2/1995 | Melzer et al. . | |
| 5,396,853 | 3/1995 | Huang . | |

*Primary Examiner*—Ismael Izaguirre
*Attorney, Agent, or Firm*—Barnes & Thornburg

[57] ABSTRACT

A manually driven stitcher or sewing machine. A lever of the stitcher is manually pivotable through an arc to reciprocate a stitching mechanism. When pivoted through the arc, the lever also actuates a clamping assembly, an article advancing mechanism, and a stitching material supplying assembly. The stitcher or sewing machine of the present invention may be used to manually stitch a variety of materials including heavier ones such as leather, nylon strapping, plastic, and rubber.

26 Claims, 5 Drawing Sheets

MANUALLY OPERATED STITCHER

BACKGROUND AND SUMMARY OF THE INVENTION

The present invention relates to a manually driven stitcher or sewing machine. More particularly, the present invention relates to a stitcher or sewing machine manually driven by a lever driven mechanism that reciprocates a stitching mechanism and actuates a clamping assembly, an article advancing mechanism, and a stitching material supplying assembly to stitch an article upon pivoting of a lever through an arc.

Stitchers may be broadly classified into two categories: those that are manually driven (e.g., grip action stitchers such as those shown, for example, in U.S. Pat. Nos. 2,594,534; 2,479,017; and 402,597) and those that are driven by mechanical means, such as motors. Manually driven stitchers are typically used to stitch or sew light fabrics that do not require much force to penetrate the material being stitched, allowing a manual gripping action to be used to actuate the stitcher. A problem arises, however, with such grip action stitchers when heavier materials such as leather, nylon strapping, plastic, and rubber are to be stitched. With such materials and other thicker fabrics, the ability to manually grip with a sufficient force to penetrate the material limits what can be stitched by such devices. Resort must be had to mechanically driven stitchers that use motors to provide a force sufficient to stitch such heavier materials.

A manually driven stitcher that works on such heavier materials would be a welcome improvement. The present invention represents such an improvement. An embodiment of the present invention is a manually actuated stitcher that includes a frame, a lever, a needle, a drive mechanism, a clamping assembly, and an advancing mechanism. The frame has a stitching table on which an article is placed for stitching. The lever is coupled to the frame and is manually pivotable through an arc. The needle stitches the article and the drive mechanism is coupled to the lever and the needle for converting angular movement of the lever into reciprocatory movement of the needle. The needle moves toward the stitching table of the frame when the lever is pivoted in a first lever direction and away from the stitching table of the frame when the lever is pivoted in a second lever direction. The clamping assembly retains the article on the stitching table of the frame. The clamping assembly moves away from the stitching table of the frame during a first portion of the arc through which the lever is pivoted in the first lever direction and toward a position adjacent the stitching table of the frame during a second portion of the arc through which the lever is pivoted in the first direction. The advancing mechanism indexes the article along the stitching table of the frame while the clamping assembly is moved from the position adjacent the stitching table of the frame. Further possible components and features of the above-described embodiment of the invention are described below.

The above-described embodiment of the present invention may additionally include a bobbin positioned beneath the stitching table. The drive mechanism is coupled to the lever and bobbin to actuate the bobbin when the lever is pivoted through a portion of the arc. The bobbin may move in a first bobbin direction as the lever is pivoted in the first lever direction and a second bobbin direction as the lever is pivoted in the second lever direction. The first bobbin direction may be opposite the second bobbin direction. The drive mechanism may include a rod having a first gear on a first end thereof and a second end coupled to the bobbin, a rack matched with the first gear, and a second gear on the lever and meshed with the rack.

The second lever direction may be opposite the first lever direction. The arc through which the lever is manually pivotable may be at least ninety degrees. The needle may reciprocate perpendicularly with respect to the stitching table.

The drive mechanism may include a rod coupled to the lever, the rod rotating about an axis as the lever is pivoted through the arc, and a drive member coupled to the rod and needle, the drive member rotating with the rod. The drive mechanism may also include a cam coupled to the rod and a first cam follower coupled to the drive member. The drive member and first cam follower rotate the cam with the rod. Additionally, the clamping assembly may include a presser foot and a second cam follower coupled to the presser foot and driven by the cam to lift the presser foot away from the position adjacent to the stitching table.

The advancing mechanism may include a sliding member that engages the article to laterally displace the article on the stitching table. The stitcher may additionally include a cam on the advancing mechanism and a cam follower, the position of which with respect to the cam may be adjusted to control further lateral displacement of the sliding member and article on the stitching table.

The stitcher may additionally include a clamping assembly lifting mechanism that is actuable to selectively move the clamping assembly away from and toward the stitching table. The clamping assembly lifting mechanism may include a second lever and a cable assembly coupled to the second lever and clamping assembly. The cable assembly converts movement of the lever into movement of the clamping assembly. Movement of the second lever in a first direction moves the clamping assembly away from the stitching table and movement of the second lever is a second direction moves the clamping assembly toward the stitching table.

According to another embodiment of a manually driving stitcher constructed in accordance with the present invention includes structure for supporting an article to be stitched, structure for stitching the article, advancing structure for indexing the article during each stitching cycle, and lever structure coupled to the stitching structure and advancing structure for converting angular movement or pivoting of the lever structure into reciprocatory movement of the stitching structure and lateral movement of the advancing structure. Further possible components and features of the immediately preceding above-described embodiment of the invention are described below.

The stitching cycle may include one complete reciprocatory stroke of the stitching structure.

The stitcher may additionally include clamping structure for retaining the article on the supporting structure during a portion of the stitching cycle. The lever structure may be coupled to the clamping structure to control actuation of the damping structure during pivoting of a lever of the lever structure through an arc. The clamping structure may move away from the supporting structure during pivoting of the lever through a first portion of the arc and move toward a position adjacent the supporting structure during pivoting of the lever through a second portion of the arc.

The lever of the lever structure may be pivotable through an arc of at least ninety degrees. The lever may be pivotable through the arc in both a first and second direction. The drive mechanism may be coupled to the lever for converting angular movement of the lever into reciprocatory movement of the stitching structure and lateral movement of the advancing structure.

The stitching structure may include a needle. The stitching structure may move toward the supporting structure when the lever is pivoted in a first direction and away from the supporting structure when the lever is pivoted in a second direction. The drive mechanism may include a rod coupled to the lever, the rod rotating about an axis as the lever is pivoted through the arc and a drive member coupled to the rod and needle, the drive member rotating with the rod. The stitcher may additionally include a clamping structure for retaining the article on the supporting structure during a portion of a stitching cycle. The lever structure may include a cam coupled to the rod and a first cam follower coupled to the drive member. The drive member and first cam follower rotate the cam with the rod. The clamping structure additional includes a presser foot and a second cam follower coupled to the presser foot and driven by the cam to lift the presser foot away from a position adjacent the supporting structure.

This embodiment of the stitcher of the present invention may additionally include structure for lifting the clamping structure away from a position adjacent the supporting structure. The lifting structure may include a lever and a cable assembly coupled to the lever and clamping structure so that pivoting of the lever in first direction moves the clamping structure away from the supporting structure and pivoting of the lever in a second direction moves the clamping structure toward the supporting structure.

The supporting structure may include a stitching table. The advancing structure may include a sliding member that engages the article to laterally displace the article on the supporting structure. The stitcher may include a cam on the advancing structure and a cam follower, the position of which with respect to the cam may be adjusted to control further lateral displacement of the sliding structure and article on the supporting structure.

The stitcher may additionally include structure positioned beneath the article for supplying stitching material to the stitching structure. The supplying structure may include a bobbin. The lever structure may include a rod having a first gear on a first end thereof and a second end coupled to the supplying structure, and a rack meshed with the first gear.

Lever actuation or operation of the stitcher of the present invention provides mechanical advantage in the form of sufficient force to penetrate and thereby stitch heavier articles such as leather, nylon strapping, plastic and rubber. Additionally, the stitcher of the present invention is mechanically simplified by using the lever to actuate various components of the stitcher, including a reciprocating needle, raising and lowering of a presser foot of a clamping assembly, actuation of a bobbin, pulling and tightening of stitching material to complete a stitch, and indexing of an article on a stitching table of the stitcher by an advancing mechanism.

Other objects, advantages and novel features of the present invention will become apparent from the following detailed description of the invention when considered in conjunction with the accompanying drawings.

BRIEF DESCRIPTION OF THE DRAWINGS

The present invention will be described hereafter with reference to the attached drawings which are given as non-limiting examples only, in which.

DETAILED DESCRIPTION OF THE DRAWINGS

Figure 1:
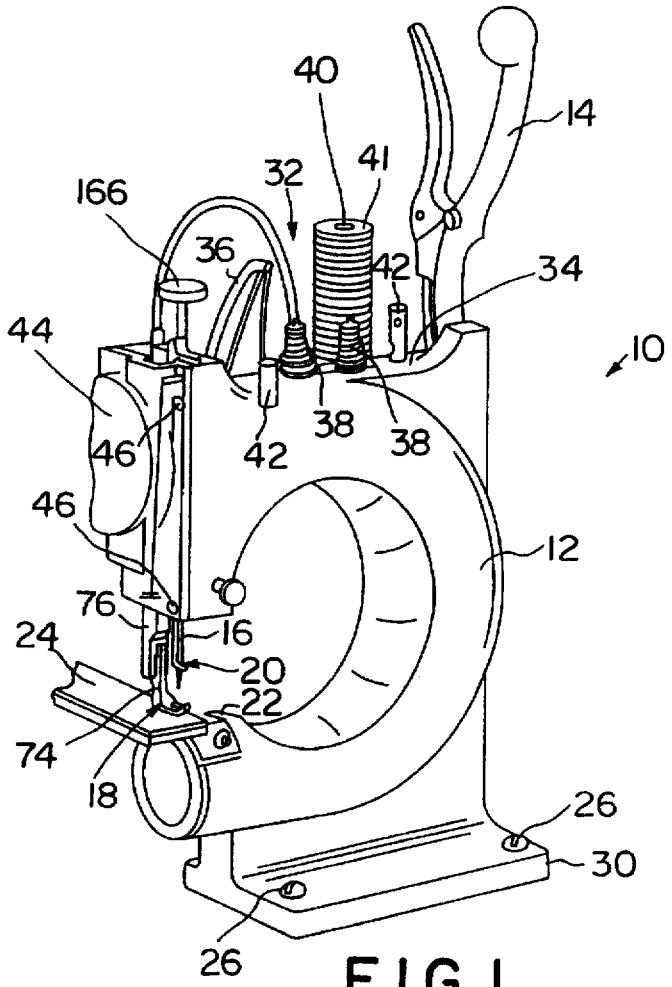
FIG. 1 is a perspective view of an embodiment of a lever actuated stitcher of the present invention.
Figure 2:
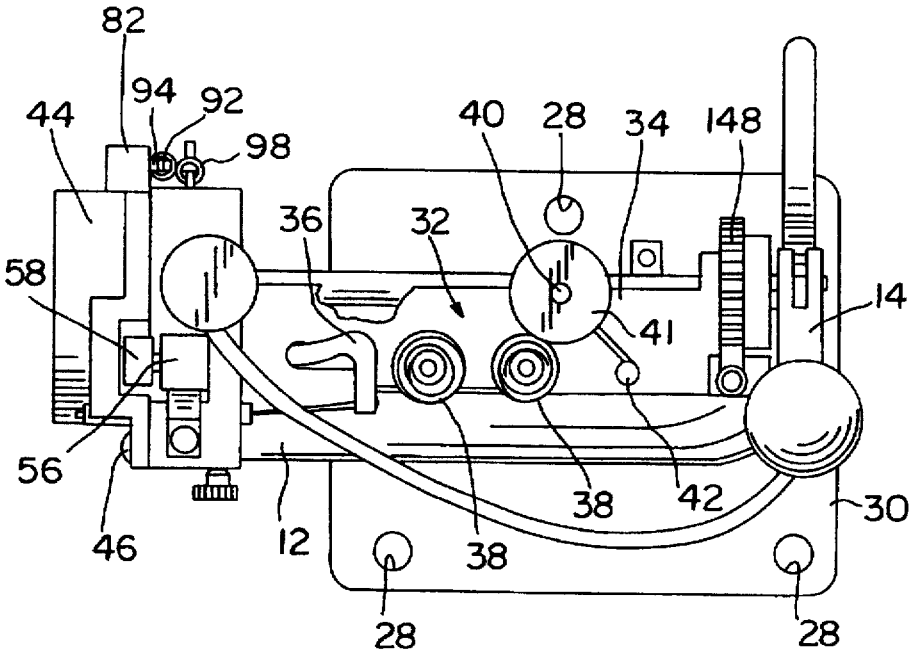
FIG. 2 is top view of the stitcher of FIG. 1.

A perspective view of an embodiment of a lever actuated stitcher 10 of the present invention is shown in FIG. 1. Stitcher 10 includes a frame or housing 12 to which a lever 14, needle 16, clamping assembly 18, and advancing mechanism 20 are coupled. Stitcher 10 includes a stitching table 22 on which an article 24 is placed for stitching. Frame 12 may be secured to another structure via such means as fasteners 26 disposed through openings 28 formed in base 30 of frame 12 as shown in FIG. 2.

Various thread or stitching material handling components, generally designated by arrow 32, are disposed on top portion 34 of frame 12. Thread handling components 32 include thread take up arm 36, spring biased thread guides 38, spool shaft 40 on which a spool of thread 41 is placed, and thread guides 42.

Stitcher 10 includes a cover 44 secured to frame 12 via a plurality of fasteners 46. Cover 44 may be removed to access a portion of a drive mechanism 48 of stitcher 10, as discussed more fully below. Cover 44 may remain in place during operation of stitcher 10 help to protect the drive mechanism from damage and contamination by debris.

Figure 3:
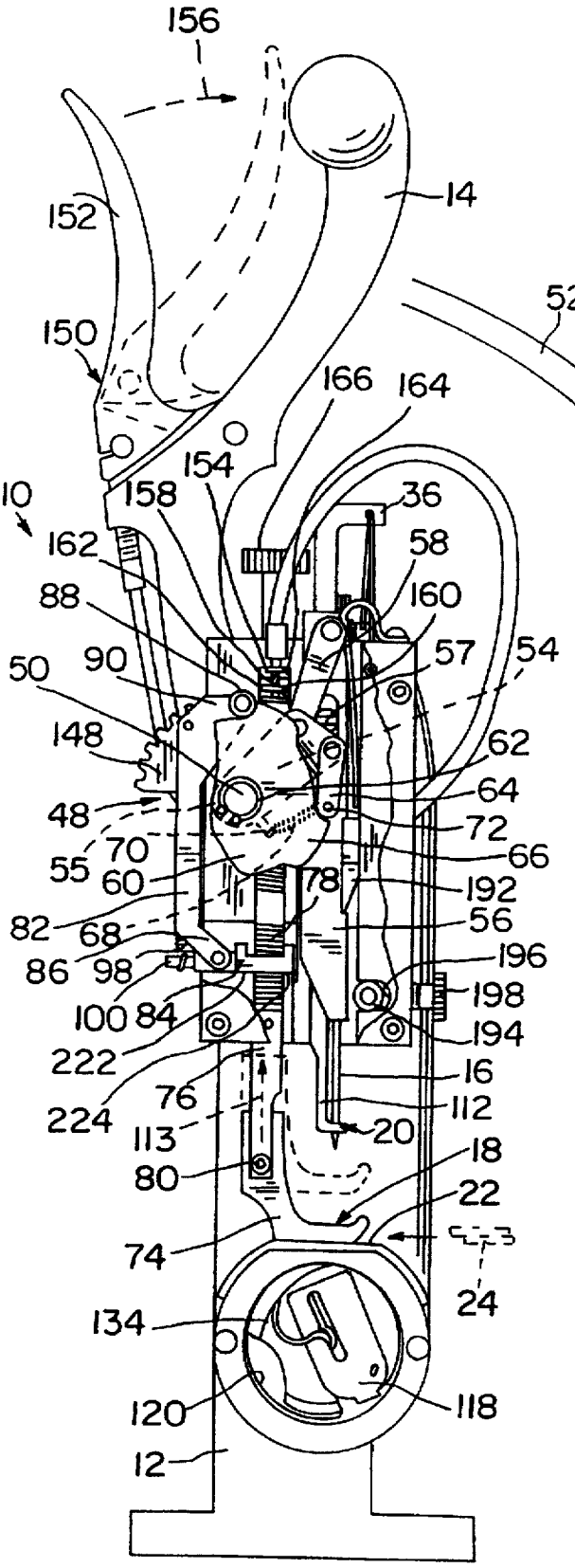
FIG. 3 is a left side view of the stitcher of FIG. 1 with a cover of the stitcher removed.
Figure 4:
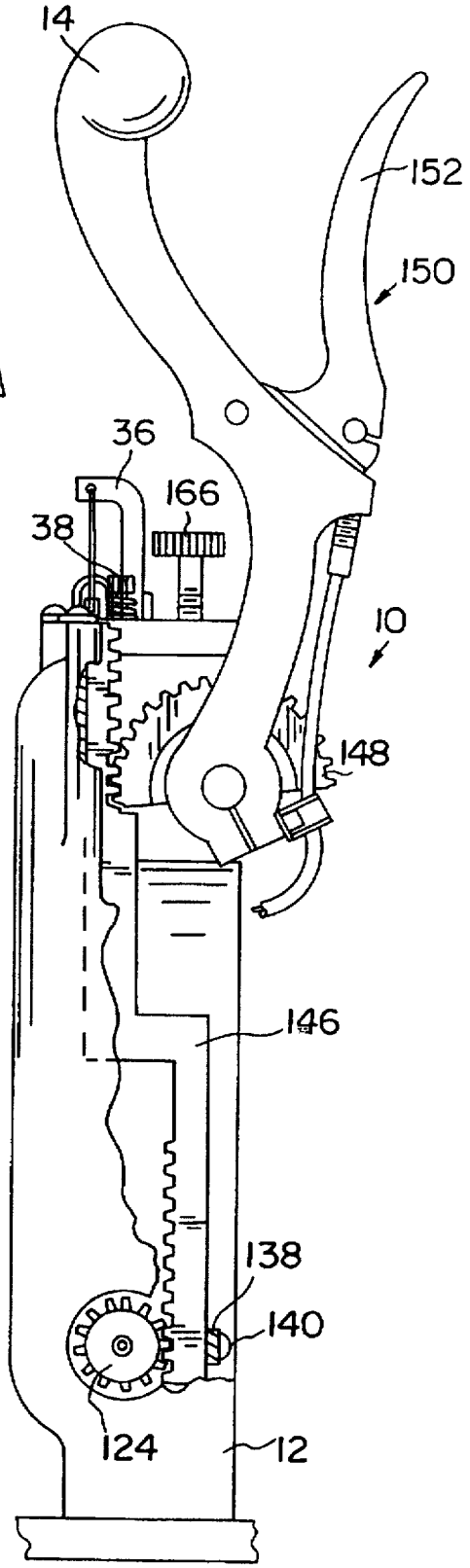
FIG. 4 is a right side, partial cross-sectional view of the stitcher of FIG. 1.
Figure 5:
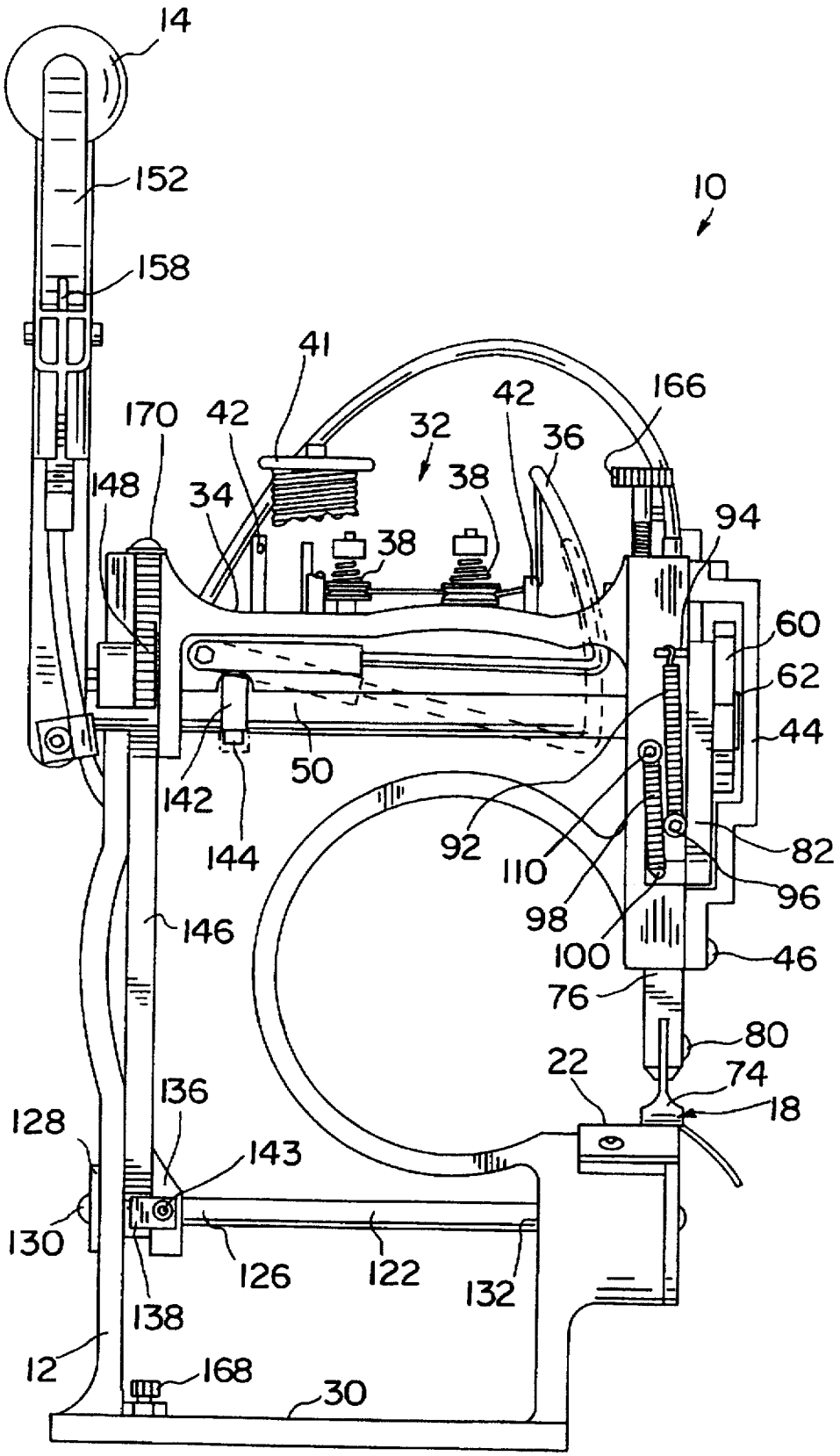
FIG. 5 is a rear view of the stitcher of FIG. 1.

Left and right side views of stitcher 10 are respectively shown in FIGS. 3 and 4. FIG. 3 shows components of the above-described drive mechanism 48 which are visible when cover 44 is removed. As can be seen from a combination of FIGS. 3–5, drive mechanism 48 includes a rod 50 coupled to lever 14 that rotates about a longitudinal axis extending therethrough as lever 14 is pivoted through an arc, the direction of which is generally indicated by large arrow 52. Rod 50 of drive mechanism 48 rotates in bearing 142 which is coupled to frame 12 and secured around rod 50 via a fastener 144, as shown in FIG. 5. Drive mechanism 48 also includes a drive member 54 coupled on one end 55 to rod 50 and on another end 57 to needle housing 56, in which needle 16 is disposed, via link 58. Drive mechanism 48 also includes a cam 60 coupled to rod 50 via means such as lock washer 62 and a first cam follower 64 coupled to drive member 54. As shown in FIG. 3, first cam follower 64 is biased in engagement with one of raised portions 66 of cam 60 via a biasing means such as spring 68 coupled to first cam follower 64 and drive member 54 via respective pins 72 and 70. Drive member 54 frictionally engages cam 60 and first cam follower 64 engages one of raised portions 66 of cam 60 to rotate cam 60 with rod 50. Thus, pivoting of lever 14 through the arc generally indicated by arrow 52 converts angular movement of lever 14 into movement of needle housing 56 and needle 16 toward stitching table 22. Pivoting of lever 14 in a direction generally opposite that indicated by arrow 52 converts angular movement of lever 14 into movement of needle housing 56 and needle 16 in a direction away from stitching table 22.

As discussed above in connection with FIG. 1, stitcher 10 includes a clamping assembly 18. Clamping assembly 18 includes a presser foot 74 and a presser foot carrier rod 76 having a plurality of threads 78 formed thereon. Presser foot carrier rod 76 is coupled to presser foot 74 via fastener 80. Presser foot 74 is normally urged to a position adjacent stitching table 22 by a biasing member such as spring 162, disposed within slot 160 in which presser foot carrier rod 76 is also disposed. Clamping assembly 18 also includes a second cam follower 82 coupled to presser foot 74 via presser foot carrier rod 76 and presser foot carrier rod locking member 84 which is connected to an end 86 of second cam follower 82. A roller 88 is connected to end 90 of second cam follower 82. Roller 88 of clamping assembly 18 is biased against cam 60 of drive mechanism 48 via a resilient member, such as spring 92, visible in FIGS. 2 and 5. Spring 92 is coupled to second cam follower 82 via a pin 94 and to frame or housing 12 via fastener 96 as shown, for example, in FIG. 5. A second resilient member, such as spring 98, is coupled to presser foot carrier rod locking member 84 via pin 100 and to frame 12 via fastener 110 as shown, for example, in FIG. 5.

Second cam follower 82 is driven by cam 60, as more fully discussed below, to lift presser foot 74 against the bias of spring 162 from a position adjacent stitching table 22 during a portion of each stitching cycle. Presser foot 74 moves away from a position adjacent stitching table 22 in a direction generally indicated by arrow 113.

As discussed above in connection with FIG. 1, stitcher 10 additionally includes an advancing mechanism 20. Advancing mechanism 20 indexes article 24 along stitching table 22 when clamping assembly 18 is removed from a position adjacent stitching table 22. Advancing mechanism 20 includes a sliding member 112 disposed within needle housing 56.

Figure 6:
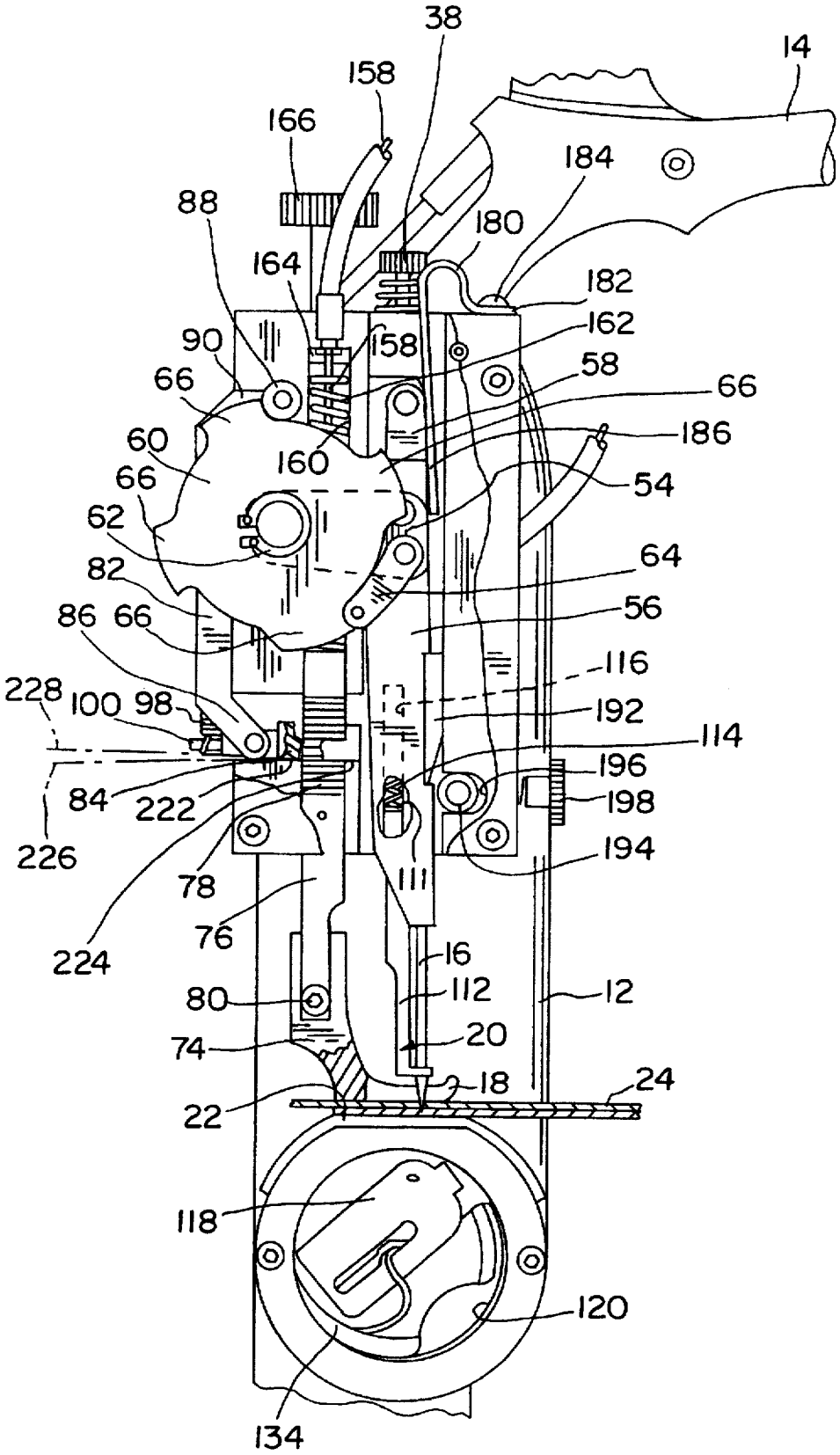
FIG. 6 is a left side view of the stitcher of FIG. 1 with the cover of the stitcher removed and the lever of the stitcher pivoted to approximately a mid-way position.
Figure 7:
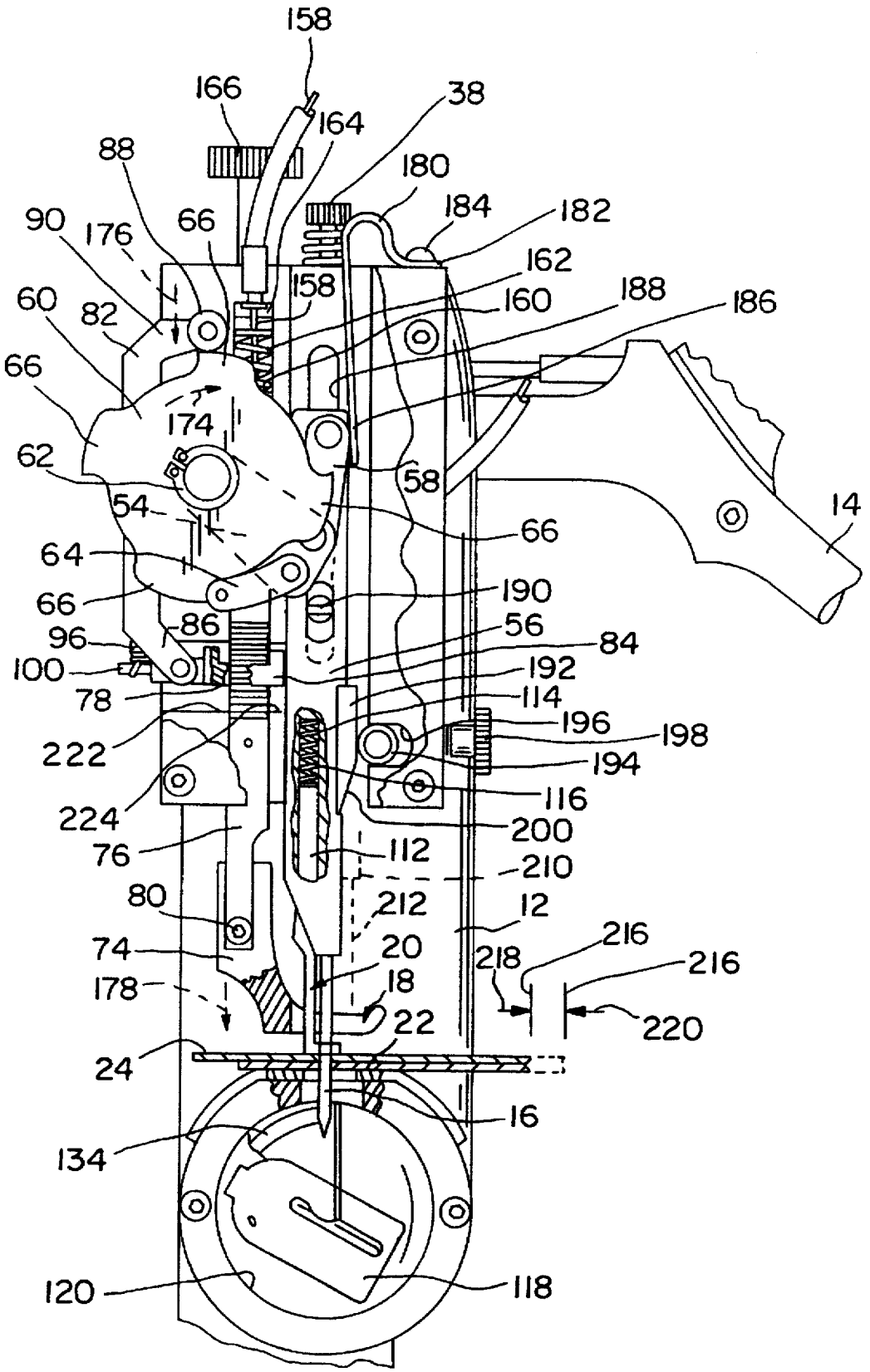
FIG. 7 is a view similar to that of FIG. 6 with the lever of the stitcher pivoted further to almost a final position.

As can be seen in FIG. 6 and 7, a resilient member, such a spring 114, is disposed within cavity 116 in needle housing 56 against an end 111 of sliding member 112. This allows sliding member 112 to reciprocate within cavity 116 in needle housing 56 as needle 116 reciprocally moves toward and away from stitching table 22 of frame 12 through pivoting of lever 14.

Stitcher 10 additionally includes a bobbin 118 disposed beneath stitching table 22 in cavity 120 of frame 12. Bobbin 118 is coupled to lever 14 via drive mechanism 48 to actuate bobbin 118 when lever 14 is pivoted through the arc generally indicated by arrow 52. As can be seen in FIGS. 4 and 5, drive mechanism 48 also includes a rod 122 having a first gear 124 coupled to a first end 126 of rod 122 via a washer 128 and a fastener 130 disposed in frame 12, and a second end 132 coupled to bobbin 118 via bobbin cage 134. Rod 122 rotates in a bearing 136 coupled to frame 12 via block 138 and fastener 140.

Drive mechanism 48 also includes a rack 146 meshed with both first gear 124 on rod 122 and second gear 148 coupled to lever 14. Pivoting of lever 14 in an arc generally indicated by arrow 52 drives rack 146 away from lever 14 to rotate shaft 122 and bobbin 118 in a first bobbin direction. Pivoting of lever 14 through an arc generally opposite that indicated by arrow 52 causes rack 146 to move upward toward lever 14 which causes rod 122 and bobbin 118 to rotate in a second bobbin direction generally opposite the first bobbin direction.

Stitcher 10 also includes a clamping assembly lifting mechanism 150 that may be actuated to selectively move clamping assembly 18 away from and toward stitching table 22. Clamping assembly lifting mechanism 150 includes a second lever 152 and a cable assembly 154 coupled to second lever 152 and clamping assembly 18 so that movement of second lever 152 in a direction generally indicated by arrow 156 moves clamping assembly 18 against the bias of spring 162 away from stitching table 22 and movement of second lever 152 in a direction generally opposite that of arrow 156, allows clamping assembly 18 to move toward a position adjacent stitching table 22 under the urging of biasing member 162. Cable assembly 154 includes a cable 158 having one end connected to second lever 152 and an opposing end connected to presser foot carrying rod 76. Biasing member or spring 162 is disposed in slot 160 between presser foot carrier rod 76 and tensioning block 164. Tensioning block 164 is disposed within slot 160 between spring 162 and a tensioning knob 166. Knob 166 may be rotated to translate block 164 within slot 160 compressing or expanding spring 162. Rotation of knob 166 is a first direction compresses spring 162 increasing the force required to actuate second lever 152 to lift clamping assembly from a position adjacent stitching table 22. Rotation of knob 166 in an opposite direction reduces compression in spring 162, by expanding it, thereby reducing the force required to actuate second lever 152 in the direction of arrow 156.

A stop, 168 coupled to base 30 of frame 12 limits pivotal movement of lever 14 in the direction generally indicated by arrow 52. Movement of lever 14 in the direction of arrow 52 causes rack 146 to move away from lever 14 toward stop 168 until it abuts against stop 168, at which point lever 14 is prevented from moving any further in the direction of arrow 52. Pivoting of lever 14 in a direction generally opposite arrow 52 is limited by stop 170 coupled to top 34 of frame 12 when rack 146 abuts against stop 170, preventing further movement of lever 14 in that direction.

In operation, an article 24 to be stitched is initially placed on stitching table 22 of frame 12 by lifting clamping assembly 18 away from a position adjacent stitching table 22 through actuation of clamping assembly lifting mechanism 150, as discussed above. After article 24 is placed on stitching table 22, clamping assembly lifting mechanism 150 is released to place the article between stitching table 22 and clamping assembly 18 as shown in FIG. 1. Next, lever 14 is pivoted in the direction generally indicated by arrow 52 in FIG. 3 to begin stitching of article 24. Lever 14 eventually assumes approximately a midway position, shown in FIG. 6. In this lever 14 position, needle 16 begins penetration of article 24, cam 60 has rotated clockwise under the influence of drive member 54 from the position shown in FIG. 3, and bobbin 118 has rotated in a counter clockwise direction from the position shown in FIG. 3. Further pivoting of lever 14 in a direction generally indicated by arrow 52 continues until lever 14 reaches a position shown in FIG. 7. In this position, needle 16 has fully penetrated article 24 and bobbin 18 has further rotated in a counter clockwise direction from the position shown in FIG. 6. Cam 60 has further rotated clockwise under the urging of drive member 54 as generally indicated by arrow 174. This rotation causes raised portion 66 of cam 60 to engage roller 88 and thereby lift second cam follower 82 from the position shown in FIG. 6 to the position shown in FIG. 7. Lifting of second cam follower 82 causes clamping assembly 18 connected thereto to move away from a position adjacent article 24 and stitching table 22 shown in FIG. 6 to the position shown in FIG. 7. Further movement of lever 14 in the direction generally indicated by arrow 52 will cause raised portion 66 to pass roller 88 so that spring 92 urges second cam follower 82 downward in a direction generally indicated by arrow 176, causing clamping assembly 18 to move in a direction generally indicated by arrow 178 to again assume a position adjacent article 24 and stitching table 22.

As clamping assembly 18 is lifted away from a position adjacent article 24 and stitching table 22, advancing mechanism 20 indexes article 24 along stitching table 22. This is accomplished by laterally moving sliding member 112 from the position shown in FIG. 6 to the position shown in FIG. 7. This lateral movement results from the urging of resilient member 180. Resilient member 180 has a first end 182 coupled to frame 112 via fastener 184 and a second end 186 abutting against needle housing 56 with a sufficient force to cause needle housing 56 to translate laterally during a portion of the reciprocatory stroke of needle housing 56 and needle 16. Such lateral translation is possible through sizing of slot 188 in which pin member 190 of needle housing 56 reciprocatorily moves under the urging of drive member 54. This is accomplished by increasing the width of slot 188 in a direction toward stitching table 22.

A cam 192 on needle housing 56 and a cam follower 194 disposed within slot 196 in frame 12 may be used to control further lateral displacement of sliding member 122. Such further lateral displacement is accomplished by moving cam follower 194 with respect to cam 192 via knob 198. As can seen in FIG. 7, cam follower 194 has been moved sufficiently toward cam 192 by knob 198 so that contact between cam 192 and cam 194 occurs initially along inclined portion 200. Lateral displacement of needle housing 56 and advancing mechanism 20, including sliding member 112, is generally indicated by dashed line 210 in FIG. 7. Lateral displacement of needle 16 is generally indicated by dashed line 212 in FIG. 7.

Lateral displacement of sliding member 112 results in material 24 being laterally displaced or indexed along stitching table 22. Such indexing or lateral displacement is generally indicated by lines 214 and 216 and arrows 218 and 220 in FIG. 7. The distance between lines 214 and 216 may be increased or decreased by changing the position of cam follower 194 within slot 196 via knob 198. Specifically, the distance is increased by turning knob 198 so that cam follower 194 moves toward cam 192 and decreased by turning knob 198 so that cam follower 194 moves away from cam 192. The distance may also be changed by resizing slot 188.

As can be seen in FIG. 3, presser foot carrier rod locking member 84 rests against ledge portions 222 and 224 of frame 12 when lever 14 is positioned generally upright or vertical with respect to base 30 so that member 84 is substantially level. As lever 14 is pivoted in a direction generally indicated by arrow 52, member 84 is lifted away from ledge portion 22 by second cam follower 82 and angled slightly under the urging of spring 98 as generally indicated by lines 226 and 228 in FIG. 6. As noted above, presser foot carrier rod 76 includes a plurality of threads 78. Threads 78 are formed so that when member 84 is angled as shown in FIG. 6, member 84 grips them to prevent clamping assembly 18 from moving downward, under the urging of spring 162, toward stitching table 22. Threads 78 are also formed so that further upward movement of clamping assembly 18 via clamping assembly lifting mechanism 150 is permitted while presser foot 74 is away from a position adjacent stitching table 22. Member 84 releases its engagement with threads 78 of rod 76, allowing camping assembly 18 to return to a position adjacent stitching table 22 when member 84 is again positioned substantially level by engagement between ledge portions 222 and 224.

A stitching cycle is completed by pivoting lever 14 from a bottom position approximately shown in FIG. 7, along an am generally opposite that indicated by line 52 to a position shown in FIG. 3. Such movement pulls needle 16 through and away from article 24, returns clamping assembly 18 to a position adjacent article 24 and stitching table 22, rotates bobbin 118 in a clockwise direction to the position shown in FIG. 3, laterally displaces advancing mechanism 20 to return it to the position shown in FIG. 3, and pulls and tightens the stitching material. A further stitch in article 24 is made by again pivoting lever 14 along the arc generally indicated by arrow 52 to the position shown in FIG. 7 and again returning lever 14 to the position shown in FIG. 3 by pivoting lever 14 through an arc generally opposite that indicated by arrow 52.

Stitcher 10 of the present invention provides a simplified manually actuated stitcher capable of stitching or sewing heavier materials, such as leather, nylon strapping, plastic, and rubber. Lever 14 provides mechanical advantage not possible with known grip action stitchers and sewing machines that may only be used to stitch or sew light fabrics which do not require much force to penetrate the material being stitched. In addition, the lever and drive mechanism of the present invention provide a simplified design that reciprocates a stitching needle, actuates a bobbin, indexes material being stitched, pulls and tightens stitching material to complete a stitch, and raises and lowers a clamping assembly all through an angular pivoting of lever 14. This provides simplified reliable operation. Further, the clamping assembly may be manually raised and lowered through clamping assembly lifting mechanism 150 to easily load and unload articles from stitcher 10.

From the preceding description of the preferred embodiments, it is evident that the objects of the invention are attained. Although the invention has been described and illustrated in detail, it is to be clearly understood that the same is intended by way of illustration and example only and is not to be taken by way of limitation. The spirit and scope of the invention are to be limited only by the terms of the appended claims.

What is claimed:

1. A manually actuated stitcher, comprising:

a frame having a stitching table on which an article is placed for stitching;

a lever coupled to the frame and manually pivotable through an arc;

a needle for stitching the article;

a drive mechanism coupled to the lever and the needle for converting angular movement of the lever into reciprocatory movement of the needle, the needle moving toward the stitching table of the frame when the lever is pivoted in a first lever direction and away from the stitching table of the frame when the lever is pivoted in a second lever direction;

a clamping assembly for retaining the article on the stitching table of the frame, the clamping assembly moving away from the stitching table of the frame during a first portion of the arc through which the lever is pivoted in the first lever direction and moving toward a position adjacent the stitching table of the frame during a second portion of the arc through which the lever is pivoted in the first lever direction; and an advancing mechanism indexing the article along the stitching table of the frame while the clamping assembly is moved from the position adjacent the stitching table of the frame.

2. The stitcher of claim 1, further comprising a bobbin positioned beneath the stitching table, and wherein the drive mechanism is coupled to the lever and bobbin to actuate the bobbin when the lever is pivoted through at least a portion of the arc.

3. The stitcher of claim 2, wherein the bobbin moves in a first bobbin direction as the lever is pivoted in the first lever direction and a second bobbin direction as the lever is pivoted in the second lever direction.

4. The stitcher of claim 3, wherein the first bobbin direction is opposite the second bobbin direction.

5. The stitcher of claim 2, wherein the drive mechanism includes a rod having a first gear on a first end thereof and a second end coupled to the bobbin, a rack meshed with the first gear, and a second gear on the lever and meshed with the rack.

6. The stitcher of claim 1, wherein the second lever direction is opposite the first lever direction.

7. The stitcher of claim 1, wherein the arc through which the lever is manually pivotable is at least ninety degrees.

8. The stitcher of claim 1, wherein the needle reciprocates perpendicularly with respect to the stitching table.

9. The stitcher of claim 1, wherein the drive mechanism includes a rod coupled to the lever, the rod rotating about an axis as the lever is pivoted through the arc, and a drive member coupled to the rod and needle, the drive member rotating with the rod.

10. The stitcher of claim 9, wherein the drive mechanism also includes a cam coupled to the rod and a first cam follower coupled to the drive member, the drive member and first cam follower rotating the cam with the rod, and further wherein the clamping assembly includes a presser foot and a second cam follower coupled to the presser foot and driven by the cam to lift the presser foot away from the position adjacent the stitching table.

11. The stitcher of claim 1, wherein the advancing mechanism includes a sliding member that engages the article to laterally displace the article on the stitching table.

12. The stitcher of claim 11, further comprising a cam on the advancing mechanism and a cam follower, the position of which with respect to the cam may be adjusted to control further lateral displacement of the sliding member and article on the stitching table.

13. The stitcher of claim 1, further comprising a clamping assembly lifting mechanism that is actuable to selectively moves the clamping assembly away from and toward the stitching table.

14. The stitcher of claim 13, wherein the clamping assembly lifting mechanism includes a second lever and a cable assembly coupled to the second lever and clamping assembly whereby movement of the second lever in a first direction moves the clamping assembly away from the stitching table and movement of the second lever in a second direction moves the clamping assembly toward the stitching table.

15. A manually driven stitcher, comprising:

means for supporting an article to be stitched;

means for stitching the article;

advancing means for indexing the article during each stitching cycle;

lever means coupled to the stitching means and advancing means for convening angular movement of the lever means into reciprocatory movement of the stitching means and lateral movement of the advancing means; and clamping means for retaining the article on the supporting means during a portion of the stitching cycle, wherein the lever means is coupled to the clamping means to control actuation of the clamping means during pivoting of the lever means through an arc, the clamping means moving away from the supporting means during pivoting of the lever through a first portion of the arc and moving toward a position adjacent the supporting means during pivoting of the lever through a second portion of the arc.

16. The stitcher of claim 15, wherein the lever means includes a lever pivotable through an arc of at least ninety degrees.

17. A manually driven stitcher, comprising:

means for supporting an article to be stitched;

means for stitching the article;

advancing means for indexing the article during each stitching cycle; and lever means coupled to the stitching means and advancing means for converting angular movement of the lever means into reciprocatory movement of the stitching means and lateral movement of the advancing means, the lever means including a lever pivotable through an arc in both a first and second direction, and a drive mechanism coupled to the lever for converting angular movement of the lever into reciprocatory movement of the stitching means and lateral movement of the advancing means, wherein the drive mechanism includes a rod coupled to the lever, the rod rotating about an axis as the lever is pivoted through the arc and a drive member coupled to the rod and needle, the drive member rotating with the rod.

18. The stitcher of claim 17, wherein the stitching cycle includes one complete reciprocatory stroke of the stitching means.

19. The stitcher of claim 17 wherein the stitching means includes a needle.

20. The stitcher of claim 17, further comprising clamping means for retaining the article on the supporting means during a portion of a stitching cycle, wherein the lever means includes a cam coupled to the rod and first cam follower coupled to the drive member, the drive member and first cam follower rotating the cam with the rod, and further wherein the clamping means includes a presser foot and a second cam follower coupled to the presser foot and driven by the cam to lift the presser foot away from a position adjacent the supporting means.

21. The stitcher of claim 15 or 17 further comprising means for lifting the clamping means away from a position adjacent the supporting means.

22. The stitcher of claim 21, wherein the lifting means include a lever and a cable assembly coupled to the lever and clamping means so that pivoting of the lever in a first direction moves the clamping means away from the supporting means and pivoting of the lever in a second direction moves the clamping means toward the supporting means.

23. The stitcher of claim 17, wherein the supporting means includes a stitching table.

24. The stitcher of claim 17, wherein the advancing means includes a sliding member that engages the article to laterally displace the article on the supporting means.

25. The stitcher of claim 24, further comprising a cam on the advancing means and a cam follower, the position of which with respect to the cam may be adjusted to control further lateral displacement of the sliding member and article on the supporting means.

26. A manually driven stitcher, comprising:

means for supporting an article to be stitched;

means for stitching the article;

advancing means for indexing the article during each stitching cycle;

lever means coupled to the stitching means and advancing means for converting angular movement of the lever means into reciprocatory movement of the stitching means and lateral movement of the advancing means, said lever means including a rod having a first gear on a first end thereof and a second end coupled to the supplying means, and a rack meshed with the first gear; and means positioned beneath the article for supplying stitching material to the stitching means, said supplying means including a bobbin.

* * * * *